US008574687B2

(12) United States Patent
Janz et al.

(10) Patent No.: US 8,574,687 B2
(45) Date of Patent: Nov. 5, 2013

(54) METHOD AND DEVICE FOR DEPOSITING A NON-METALLIC COATING BY MEANS OF COLD-GAS SPRAYING

(75) Inventors: Dirk Janz, Berlin (DE); Jens Dahl Jensen, Berlin (DE); Jens Klingemann, Berlin (DE); Ursus Krüger, Berlin (DE); Daniel Körtvelyessy, Berlin (DE); Volkmar Lüthen, Berlin (DE); Ralph Reiche, Berlin (DE); Oliver Stier, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 629 days.

(21) Appl. No.: 12/443,264

(22) PCT Filed: Sep. 29, 2006

(86) PCT No.: PCT/DE2006/001751

§ 371 (c)(1),
(2), (4) Date: Mar. 5, 2010

(87) PCT Pub. No.: WO2008/037237

PCT Pub. Date: Apr. 3, 2008

(65) Prior Publication Data

US 2010/0183826 A1 Jul. 22, 2010

(51) Int. Cl.
*C23C 24/00* (2006.01)

(52) U.S. Cl.
USPC ..... 427/575; 427/421.1

(58) Field of Classification Search
USPC ..... 427/421.1, 575
See application file for complete search history.

(56) References Cited

U.S. PATENT DOCUMENTS

| | | | | |
|---|---|---|---|---|
| 2001/0008300 | A1 * | 7/2001 | Yoshihara et al. | 257/620 |
| 2004/0043638 | A1 * | 3/2004 | Nansei et al. | 438/792 |
| 2005/0001075 | A1 * | 1/2005 | Heinrich et al. | 239/589 |
| 2005/0003679 | A1 * | 1/2005 | Hyun et al. | 438/770 |
| 2005/0065035 | A1 * | 3/2005 | Rupich et al. | 505/300 |
| 2005/0137092 | A1 * | 6/2005 | Mester et al. | 505/100 |
| 2006/0027687 | A1 * | 2/2006 | Heinrich et al. | 241/5 |
| 2006/0090593 | A1 | 5/2006 | Liu | 75/252 |
| 2006/0093736 | A1 | 5/2006 | Raybould et al. | 427/180 |

FOREIGN PATENT DOCUMENTS

| | | | |
|---|---|---|---|
| DE | 102004059716 | * | 4/2006 |
| WO | WO 2005061116 | | 7/2005 |

OTHER PUBLICATIONS

International Search Report, PCT/DE2006/001751, 2 pages, Jun. 4, 2007.

* cited by examiner

*Primary Examiner* — Timothy Meeks
*Assistant Examiner* — Nathan T Leong
(74) *Attorney, Agent, or Firm* — King & Spalding L.L.P.

(57) ABSTRACT

In a method for depositing a non-metallic, in particular ceramic, coating on a substrate (2) by cold gas spraying, the method has the steps of: producing a reactive gas flow (5) having at least one reactive gas, injecting into the reactive gas flow (5) particles (4) consisting of at least one material required for producing a non-metallic, in particular ceramic, coating material by reaction with the reactive gas, so as to form a mixture flow of reactive gas and particles (4), producing reactive gas radicals in the mixture flow, and directing the mixture flow having reactive gas radicals and particles onto a surface of a substrate (2) to be coated, and so a non-metallic, in particular ceramic, coating is deposited on the surface of the substrate (2). In addition, a description is given of a device (1) for carrying out the method.

12 Claims, 1 Drawing Sheet

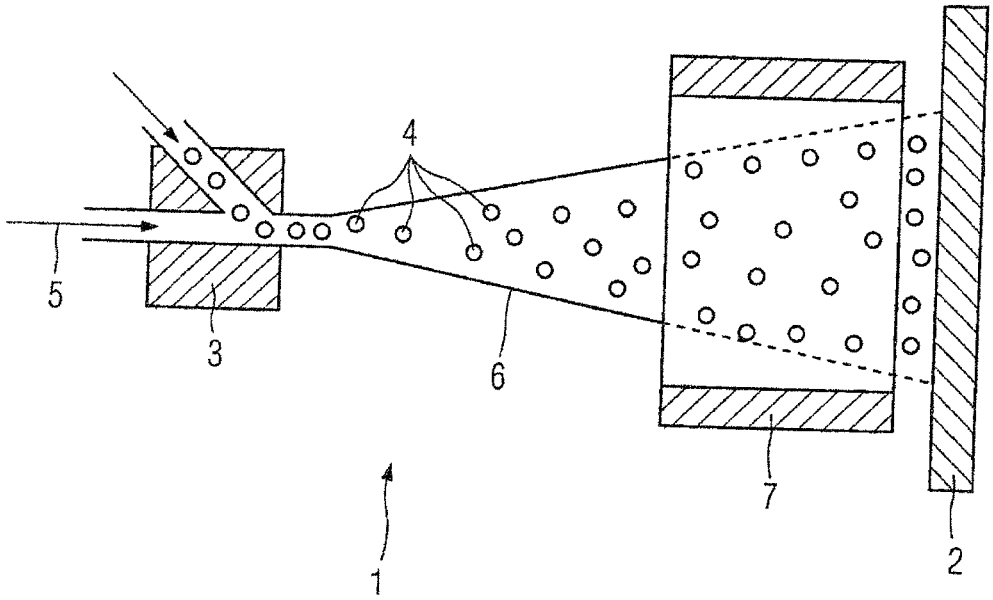
4
5
3
6
7
1
2

METHOD AND DEVICE FOR DEPOSITING A NON-METALLIC COATING BY MEANS OF COLD-GAS SPRAYING

CROSS-REFERENCE TO RELATED APPLICATIONS

This application is a United States national phase filing under 35 U.S.C. §371 of International Application No. PCT/DE2006/001751, filed Sep. 29, 2006. The complete disclosure of the above-identified application is hereby fully incorporated herein by reference.

TECHNICAL FIELD

The invention relates to a method and a device for depositing a nonmetallic, in particular ceramic coating on a substrate by means of cold gas spraying.

BACKGROUND

Cold gas spraying is a coating method by which metal layers, for instance copper, silver, aluminum and the like, can be deposited onto a substrate, for instance a workpiece to be coated.

It is only to a limited extent possible to produce ceramic layers by cold gas spraying, via the deposition of so-called composite layers. In this case, ceramic particles are embedded in larger metal particles and thereby co-deposited onto the substrate. Through suitable heat treatment of the layers deposited in this way, a ceramic layer can be generated by temperature-induced diffusion of the ceramic particles and the metal matrix.

DE 10 2004 059 716 B3 discloses a cold gas spraying method. A carrier gas flow is generated, and particles are introduced into it. The kinetic energy of the particles leads to layer formation on a substrate. The substrate has a structural texture, which is transferred onto the layer being formed.

Using a suitable composition of the particles, a high-temperature superconducting layer can thereby be produced on the substrate. Here again, subsequent heat treatment of the substrate provided with the layer is proposed.

In contrast to the typical thermal or plasma spraying methods such as vacuum plasma spraying (VPS), atmospheric plasma spraying (APS) and high velocity oxy-fuel flame spraying (HVOF), ceramic particles cannot be used directly in the cold gas spraying method since they generally do not adhere to the substrate.

SUMMARY

According to various embodiments, a method with which it is possible to deposit even nonmetallic layers, in particular ceramic layers, on a substrate or workpiece by means of cold gas spraying can be provided.

According to an embodiment, a method for depositing a nonmetallic, in particular ceramic, coating on a substrate by means of cold gas spraying, may have the method steps of: —generating a reactive gas flow comprising at least one reactive gas, —injecting particles, consisting of at least one material which is required for the generation of a nonmetallic, in particular ceramic, coating material by reaction with the reactive gas, into the reactive gas flow so as to create a mixture flow of reactive gas and particles, —generating reactive gas radicals in the mixture flow, —directing the mixture flow comprising the reactive gas radicals and particles onto a surface, which is to be coated, of a substrate, so that a nonmetallic, in particular ceramic, coating is deposited on the surface of the substrate.

According to a further embodiment, the reactive gas radicals can be generated in the mixture flow by exciting the reactive gas molecules by means of electromagnetic radiation with a suitable frequency and flux density. According to a further embodiment, the reactive gas molecules in the mixture flow can be excited by means of electromagnetic radiofrequency waves and/or microwaves and/or ultraviolet light, and/or laser light. According to a further embodiment, the method may have the additional method step of: —expanding the mixture flow after injection of the particles into the reactive gas flow and before generation of the reactive gas radicals in the mixture flow. According to a further embodiment, the expansion can be carried out in a Laval nozzle. According to a further embodiment, the expansion can be carried out in an environment with a pressure level below standard conditions. According to a further embodiment, the method may have the additional method step of: —delivering additional reactive gas to the surface, which is to be coated, of the substrate. According to a further embodiment, the particles can be agglomerated nanoparticles. According to a further embodiment, the reactive gas flow may comprise a carrier gas suitable for cold gas spraying. According to a further embodiment, the carrier gas itself can be the reactive gas. According to a further embodiment, the reactive gas can be added to the carrier gas. According to a further embodiment, the carrier gas may comprise nitrogen. According to a further embodiment, the reactive gas may comprise oxygen. According to a further embodiment, at least some of the particles may comprise a metal which forms a nonmetallic, in particular ceramic, coating material by chemical reaction with the reactive gas.

According to another embodiment, a device for depositing a nonmetallic, in particular ceramic, coating on a substrate by means of cold gas spraying, may comprise means for generating a reactive gas flow comprising at least one reactive gas, means for injecting particles, consisting of at least one material which is required for the generation of a nonmetallic, in particular ceramic, coating material by reaction with the reactive gas, into the reactive gas flow so as to create a mixture flow of reactive gas and particles, means for generating reactive gas radicals in the mixture flow, and means for directing the mixture flow comprising the reactive gas radicals and particles onto a surface, which is to be coated, of a substrate, so that a nonmetallic, in particular ceramic, coating is deposited on the surface of the substrate.

According to a further embodiment, the device may further comprise means for expanding the mixture flow after injection of the particles into the reactive gas flow and before generation of the reactive gas radicals in the mixture flow. According to a further embodiment, the means for expanding the mixture flow may comprise a Laval nozzle. According to a further embodiment, the means for generating the reactive gas radicals in the mixture flow may comprise an electromagnetic radiofrequency and/or microwave generator and/or a light source emitting ultraviolet light and/or a laser light source. According to a further embodiment, the device may further comprise means for additionally delivering reactive gas to the surface, which is to be coated, of the substrate.

BRIEF DESCRIPTION OF THE DRAWINGS

The invention will be explained in more detail below with the aid of the drawing, in which:

FIG. 1 shows a schematic representation of a device according to an embodiment for carrying out a method according to various embodiments.

DETAILED DESCRIPTION

According to an embodiment, a method for depositing a nonmetallic, in particular ceramic, coating on a substrate by means of cold gas spraying may comprise the method steps:

- generating a reactive gas flow comprising at least one reactive gas,
- injecting particles, consisting of at least one material which is required for the generation of a nonmetallic, in particular ceramic, coating material by reaction with the reactive gas, into the reactive gas flow so as to create a mixture flow of reactive gas and particles,
- generating reactive gas radicals in the mixture flow, which initiate formation of the coating material from the reactive gas and the particles,
- directing the mixture flow comprising the reactive gas radicals and particles onto a surface, which is to be coated, of a substrate, so that a nonmetallic, in particular ceramic, coating consisting of a chemical compound of the material of the particles with the reactive gas, or one which is created by chemical bonding of the material of the particles to the reactive gas, is deposited on the surface of the substrate.

The reactive gas flow may comprise a carrier gas which is conventionally used for cold gas spraying. For example, it is conceivable for the reactive gas flow to comprise a carrier gas which is conventionally used for cold gas spraying and a reactive gas which is added to the carrier gas. It is likewise conceivable for the carrier gas itself to be the reactive gas. The reactive gas flow may, for example, be generated by a reactive gas or a mixture of reactive gas and carrier gas, which is pressurized in a container, flowing out of the container for example through a pipeline or hose or the like.

Compared with conventional cold gas spraying, the method according to various embodiments adds the possibility of depositing nonmetallic, in particular ceramic, coatings on a substrate. When carrying out the method according to various embodiments to generate ceramic coatings, for example, metal powders may firstly be used as particles as in the conventional cold gas spraying method. In order to form a ceramic coating, the material of the particles must react with another chemical substance and form a chemical compound. To this end, a reactive gas is used which gives the desired chemical coating by chemical reaction with the material of the particles. For example, nitrogen or oxygen are suitable as a reactive gas. Other reactive gases may also be envisaged for the generation of, for example, carbides. In order to permit reaction of the metal particles with the reactive gas and initiate the formation of a ceramic coating, a carrier gas, which can likewise be used in conventional cold gas spraying, is added to the reactive gas. However, merely adding the generally inert reactive gas to the carrier gases is not sufficient in order to generate, for example, metal nitride compounds such as titanium nitride (TiN). To this end, the method according to various embodiments additionally comprises carrying out activation of the reactive gas by generating reactive gas radicals in the mixture flow comprising the particles and reactive gas. To this end, for example, immediately after emerging from a nozzle on the way to the substrate, the mixture flow containing the particles is passed through a radiofrequency electromagnetic field, for example through microwaves, and/or UV light. This leads to deliberate activation of the reactive gas, by which reactive gas radicals are created from the reactive gas molecules. The reactive gas radicals, which are highly reactive, initiate the formation of chemical bonds between the particles and the reactive gas so that a ceramic coating is deposited on the substrate.

In an advantageous embodiment of the method, the reactive gas radicals are generated in the mixture flow by exciting the reactive gas molecules in the mixture flow by means of electromagnetic radiation with a frequency and flux density suitable for cleaving the reactive gas molecules into reactive gas radicals. The electromagnetic radiation may have its frequency tuned deliberately to the reactive gas molecules to be activated, which are intended to be cleaved into reactive gas radicals. It is conceivable for the reactive gas molecules in the mixture flow to be excited by means of electromagnetic radiofrequency waves and/or microwaves and/or ultraviolet light, and/or laser light. All these sources of electromagnetic waves are freely available, and therefore allow economical implementation of the method according to various embodiments.

According to an embodiment, the method comprises the additional method step of expanding the mixture flow after injection of the particles into the reactive gas flow and before generation of the reactive gas radicals in the mixture flow. Reactive gas radicals can be generated more easily and with less energy expenditure in the expanded flow. It is conceivable for the expansion to be carried out in a Laval nozzle. A Laval nozzle is suitable in particular for expanding subsonic flows of cold gaseous fluids. The expansion is preferably carried out in an environment with a pressure level below standard conditions. The static pressure in the mixture flow can be reduced even further in this way, so that the formation of reactive gas molecules is even more readily possible and can be carried out with even less energy expenditure.

According to another embodiment, the method comprises the additional method step of delivering additional reactive gas to the surface, which is to be coated, of the substrate. The reaction between the particles and the reactive gas takes place only to a limited extent during transport of the mixture flow to the surface to be coated. The reaction between the particles and reactive gas takes place predominantly when the particles strike the substrate. Adding or supplying reactive gas in the vicinity of the surface to be coated therefore ensures a high partial pressure of activatable reactive gas, so that complete reaction takes place between the particles and the reactive gas to create the coating material on the surface of the substrate.

In an embodiment of the method, the particles are agglomerated nanoparticles. The reaction of the reactive gas and metal particles takes place commensurately more completely when the active surface area of the particles is larger in relation to their mass. The use of agglomerated nanoparticles therefore reliably leads to the generation of a fully reacted coating.

In another embodiment of the method, the reactive gas flow comprises a carrier gas suitable for cold gas spraying. It is conceivable for the carrier gas itself to be the reactive gas. The reactive gas may also be added to the carrier gas. The reactive gas preferably comprises nitrogen. The reactive gas may also comprise oxygen.

In another embodiment of the method, at least some of the particles comprise a metal which forms a nonmetallic, in particular ceramic, coating material by chemical reaction with the reactive gas, or with the reactive gas radicals.

According to yet another embodiment, a device for depositing a nonmetallic, in particular ceramic, coating on a substrate by means of cold gas spraying may comprise means for generating a reactive gas flow comprising at least one reactive gas, means for injecting particles, consisting of at least one material which is required for the generation of a nonmetallic, in particular ceramic, coating material by reaction with the reactive gas, into the reactive gas flow so as to create a mixture flow of reactive gas and particles, means for generating reactive gas radicals in the mixture flow, which initiate formation of the coating material from the reactive gas and the particles, means for directing the mixture flow comprising the reactive gas radicals and particles onto a surface, which is to be coated, of a substrate, so that a nonmetallic, in particular ceramic, coating consisting of a chemical compound of the material of the particles with the reactive gas, i.e. one which is created by chemical bonding of the material of the particles to the reactive gas, is deposited on the surface of the substrate.

The device according to various embodiments makes it possible to carry out a method as described above, and thus allows the advantages of the method according to various embodiments to be used.

An embodiment of the device comprises means for expanding the mixture flow after injection of the particles into the reactive gas flow and before generation of the reactive gas radicals in the mixture flow. This is advantageous because the entire particle surfaces therefore enter into the reaction kinetics. The means for expanding the mixture flow may, for example, comprise a Laval nozzle.

The means for generating the reactive gas radicals in the mixture flow may, for example, comprise an electromagnetic radiofrequency and/or microwave generator and/or a light source emitting ultraviolet light and/or a laser light source.

Another embodiment of the device comprises means for additionally delivering reactive gas to the surface, which is to be coated, of the substrate. This is advantageous in order to ensure complete reaction between the particles and reactive gas to form the coating material.

A device 1 as represented in FIG. 1 for depositing a ceramic coating on a substrate 2 by means of cold gas spraying comprises a mixing chamber 3, to which a reactive gas is delivered. The reactive gas is delivered to the mixing chamber from a container (not shown) in which there is a higher pressure than on the surface, which is to be coated, of the substrate 2. A reactive gas flow 5 is therefore formed upon entering the mixing chamber 3. Particles 4, which consist of a material that is required for the generation of a desired ceramic coating material by reaction with the reactive gas, are delivered to the reactive gas flow 5 in the mixing chamber 3. A mixture flow of reactive gas and particles 4 is thereby created at the exit of the mixing chamber 3. A Laval nozzle 6, in which the mixture flow of reactive gas and particles 4 is expanded, is arranged following the mixing chamber. A microwave generator 7 following the Laval nozzle 6 is used to generate reactive gas radicals in the mixture flow, which initiate formation of the coating material from the reactive gas and the particles. Directly after the microwave generator 7, the mixture flow comprising reactive gas radicals and particles 4 strikes a surface, which is to be coated, of the substrate 2, so that a ceramic coating of a chemical compound of the material of the particles 4 with the reactive gas, i.e. one which is created by chemical bonding 4 of the material of the particles to the reactive gas, is deposited on the surface of the substrate 2.

According to various embodiments, a carrier gas and metal powder as particles may firstly be used as in the conventional cold gas spraying method. In order to permit reaction of the metal particles with a reactive gas such as molecular oxygen $O_2$ or molecular nitrogen $N_2$, and thereby initiate the formation of ceramic layers, a reactive gas, for example molecular oxygen $O_2$, is added to the carrier gas.

As will be demonstrated below with reference to the example of nitrogen N as a reactive partner, merely adding generally inert nitrogen gas to the carrier gas, or using nitrogen gas as a carrier gas which is at the same time the reactive gas, is not sufficient in order to generate, for example, metal nitride compounds such as titanium nitride TiN. In order to make this possible, activation of the reactive gas is additionally carried out according to various embodiments. To this end, immediately after leaving the Laval nozzle 6 on the way to the substrate 2, the mixture flow containing the particles is passed through a radiofrequency electromagnetic field, which may for example be generated by microwaves, ultraviolet light or the like. This leads to deliberate activation of the reactive gas being used, so that the reactive gas molecules are cleaved to form reactive gas radicals. The reactive gas radicals, which are then highly reactive, make it possible to form chemical bonds between the metal particles 4 and the reactive gas in order to create metal-reactive gas compounds such as titanium nitride TiN, titanium oxide $TiO_2$ and the like. The reactive gas may naturally also be supplied additionally at the substrate 2, since the reaction of the metal particles 4 with the reactive gas takes place only to a limited extent during transport in the device 1 according to various embodiments comprising the mixing chamber 3, the Laval nozzle 6 and the microwave generator 7; instead, it predominately takes place when the particles 4 strike the substrate 2. Adding the reactive gas to the carrier gas of the cold gas process is advantageous since a high partial pressure of activatable reactive gas can therefore be ensured at the substrate 2.

It is important to emphasize that the reaction of the reactive gas and metal particles 4 takes place commensurately more completely when the active surface area of the particles 4 is larger in relation to their mass. Agglomerated nanoparticles are therefore preferably used as the particles 4, so that a fully reacted coating is created on the substrate 2.

Advantages of the various embodiments will be presented below with reference to the example of titanium nitride TiN. By means of a cold gas spraying method, it is economically possible to produce very thick wear-resistant layers having a layer thickness of up to a few millimeters, which are comparable in terms of their properties to those generated by means of physical vapor deposition (PVD) but at the same time can have a layer thickness which is greater by a factor of 100. The various embodiments therefore open up the completely new areas of application in the field of wear protection. The various embodiments likewise make it possible to deposit high-quality oxidic layers, and in particular to deposit high-temperature superconductor materials (HTS materials). Here, activation of the reactive gas not only facilitates formation of the desired phase, but also increases in particular its rate of formation. The latter leads to commercially lucrative processes for the production of superconductively coated bands which represent the starting material for a multiplicity of electrical engineering components, such as for shape memory effect (SME) materials, generators, transformers, superconducting current regulators or limiters, and the like.

The invention claimed is:

1. A method for depositing a ceramic coating on a substrate by cold gas spraying, the method including:

generating a reactive gas flow comprising at least one reactive gas, injecting particles, including at least one material which is required for the generation of the ceramic coating material by reaction with the reactive gas, into the reactive gas flow so as to create a mixture flow of reactive gas and particles, passing the mixture flow through a nozzle, generating reactive gas radicals in the mixture flow, the reactive gas radicals initiating formation of the ceramic coating from the at least one reactive gas and the particles, using at least one of the following applied to the mixture flow after emerging from the nozzle: electromagnetic radiofrequency waves and laser light; and directing the mixture flow comprising the reactive gas radicals and particles onto an untextured surface of the substrate, so that a ceramic coating is deposited on the surface of the substrate.

2. The method according to claim 1, further comprising expanding the mixture flow after injection of the particles into the reactive gas flow and before generation of the reactive gas radicals in the mixture flow.

3. The method according to claim 2, wherein the expansion is carried out in a Laval nozzle.

4. The method according to claim 2, wherein the expansion is carried out in an environment with a pressure level below atmospheric pressure.

5. The method according to claim 1, further comprising delivering additional reactive gas to the surface of the substrate.

6. The method according to claim 1, wherein the particles are agglomerated nanoparticles.

7. The method according to claim 1, wherein the reactive gas flow comprises a carrier gas suitable for cold gas spraying.

8. The method according to claim 7, wherein the carrier gas itself is the reactive gas.

9. The method according to claim 7, wherein the reactive gas is added to the carrier gas.

10. The method according to claim 7, wherein the carrier gas comprises nitrogen.

11. The method according to claim 7, wherein the reactive gas comprises oxygen.

12. The method according to claim 1, wherein at least some of the particles comprise a metal which forms a nonmetallic coating material by chemical reaction with the reactive gas.

* * * * *